US010968593B2

(12) United States Patent
Thoopphonthap

(10) Patent No.: US 10,968,593 B2
(45) Date of Patent: Apr. 6, 2021

(54) PRECAST REINFORCED CONCRETE HEAVY DUTY RETAINING WALL

(71) Applicant: Phiproei Thoopphonthap, Amphur Pakkred (TH)

(72) Inventor: Phiproei Thoopphonthap, Amphur Pakkred (TH)

( * ) Notice: Subject to any disclaimer, the term of this patent is extended or adjusted under 35 U.S.C. 154(b) by 0 days.

(21) Appl. No.: 16/487,445

(22) PCT Filed: Feb. 23, 2018

(86) PCT No.: PCT/TH2018/000007
§ 371 (c)(1),
(2) Date: Aug. 21, 2019

(87) PCT Pub. No.: WO2018/160143
PCT Pub. Date: Sep. 7, 2018

(65) Prior Publication Data

US 2020/0199841 A1 Jun. 25, 2020

(30) Foreign Application Priority Data

Mar. 1, 2017 (TH) ..... 1703000343

(51) Int. Cl.
*E02D 29/02* (2006.01)

(52) U.S. Cl.
CPC ..... *E02D 29/0266* (2013.01); *E02D 29/025* (2013.01)

(58) Field of Classification Search
CPC .... E02D 29/02; E02D 29/025; E02D 29/0266
USPC ..... 405/284, 285, 286
See application file for complete search history.

(56) References Cited

U.S. PATENT DOCUMENTS 1,329,893 A * 2/1920 Flynn ..... E04B 2/44 52/562
4,703,602 A * 11/1987 Pardo ..... E02D 29/0241 52/223.7
4,884,921 A * 12/1989 Smith ..... E02D 29/0241 405/286

(Continued)

FOREIGN PATENT DOCUMENTS

FR 2882376 A1 * 8/2006 ..... E01F 9/529
JP 2005290664 A * 10/2005 ..... E01F 9/529

(Continued)

*Primary Examiner* — Frederick L Lagman
(74) *Attorney, Agent, or Firm* — Mark M. Friedman

(57) ABSTRACT

A precast reinforced concrete heavy duty retaining wall comprises a precast concrete square face panel with integral four fins connected to the rear of facing and the end of each fin with integral regular octagon. A fin comprises a reinforced concrete slab and having a substantially plurality of horizontal holes along each fin panel, used for inserted horizontal rebars into each hole, and bonded the vertical rebars to the horizontal rebars in each vertical channel. Designed the rebars by professional engineer. The upper surface of regular octagon of outer left and outer right having protude male interlocking and the lower surface of regular octagon, having female interlocking, the center are substantially opposite. The upper surface of face panel having a noch male interlocking, and the lower surface having a groove female interlocking, the center are substantially opposite. The side view at both left and right having grooves.

10 Claims, 12 Drawing Sheets

(56) References Cited

U.S. PATENT DOCUMENTS

| | | | | | |
|---|---|---|---|---|---|
| 4,896,999 | A * | 1/1990 | Ruckstuhl | E04C 1/395 | 405/286 |
| 5,163,261 | A * | 11/1992 | O'Neill | B28B 7/0079 | 405/284 |
| 5,865,005 | A * | 2/1999 | Cataldo | E02D 29/025 | 405/284 |
| 6,994,495 | B1 * | 2/2006 | Carey | E02D 29/025 | 405/284 |
| 7,845,885 | B2 * | 12/2010 | Jaecklin | E02D 29/025 | 405/273 |
| 8,756,890 | B2 * | 6/2014 | Ciuperca | E04B 1/21 | 52/426 |
| 9,670,640 | B2 * | 6/2017 | Castonguay | E02D 29/025 | |
| 10,316,485 | B1 * | 6/2019 | Ness | E02D 29/025 | |
| 10,458,092 | B1 * | 10/2019 | Correia | E02D 29/025 | |
| 2005/0281626 | A1 * | 12/2005 | Smith | E02D 29/0266 | 405/286 |
| 2009/0208298 | A1 * | 8/2009 | Ness | B28B 15/005 | 405/286 |
| 2012/0063853 | A1 * | 3/2012 | Bott | E04C 1/395 | 405/284 |
| 2012/0073229 | A1 * | 3/2012 | Castonguay | E02D 29/0233 | 52/426 |
| 2015/0159339 | A1 * | 6/2015 | Castonguay | E02D 29/0233 | 405/284 |

FOREIGN PATENT DOCUMENTS

| | | |
|---|---|---|
| WO | WO 2014200444 | * 12/2014 |
| WO | WO 2015199622 | * 12/2015 |

* cited by examiner

PRECAST REINFORCED CONCRETE HEAVY DUTY RETAINING WALL

TECHNICAL FIELD

The present invention pertains generally to retaining wall, specifically the invention relates to precast reinforced concrete wall. For a completely precast reinforced concrete heavy duty retaining wall of the type typically used for earth and water retaining wall.

BACKGROUND OF THE INVENTION

Field of the Invention

The present invention pertains generally to precast reinforced concrete heavy duty retaining wall, the installation is the type of stack bond pattern. After installed precast concrete blocks by crane, then installed scaffolding and ladder attached on the wall for climbing to inserted horizontal rebars in to the loose holes and bonded vertical rebars, then installed formwork and poured fresh concrete in to each channel to completely precast reinforced concrete heavy duty retaining wall.

Description of the Prior Art

The invention of this precast concrete relates generally to reinforcement of heavy duty retaining wall in which this alternative product is substitutes reinforced concrete wall cast in place, the used of this product for national infrastructure project, relevant to earth retaining walls and water retaining walls. More particularly, the invention is direct to precast reinforced concrete wall seated on the precast foundation. Especially all steel reinforcement in which inserted in this precast concrete heavy duty retaining walls, designed by the professional project engineer.

The method to construct the reinforced concrete cast-in-place, for concrete retaining walls now and in the past, generally used wood or steel form work and scaffolding for cast fresh concrete, in which these methods affected to the significantly overall costs, having a lot of labor and time, waste of construction equipment, for cast fresh concrete, particularly wastage wood.

Precast reinforced concrete heavy duty retaining wall, uses of scaffolding and formwork only single side of rear surface, the installation is faster and easier, save time and budget, minimizes labor, and could be erected double walls to enlarge the width of wall.

Large dimension of precast reinforced concrete retaining wall capable for withstand lateral pressure by steel reinforced inserted into the internal of blocks during installed, the advantage of a combined with the economical and flexibility more than reinforced concrete cast-in-place. Mold of precast reinforced concrete heavy duty retaining wall, could be moved to cast near work site, for save the transportation costs.

So as to provide sufficient strength to withstand any lateral pressure created by earth fill on the rear side of the wall, and lateral pressure of water on the front face of the wall.

Precast reinforced concrete walls H-shape, the prior art Publication Number WO. 2015199622 have two type of blocks, a full block and a half block. A full block comprises of a pair of rectangular wall panels connected with a pair of flat panels, to have the embodiment of H-shape configuration. And a half block comprises a pair of square wall panels connected with a flat panel having horizontal rebars are embedded in both sides of wall panels. The installation are the types of running bond patterns. After installation of retaining wall completely, vertical rebars are inserted from the upper to the inner space of the wall panel, then the mass concrete is poured into an interval of the precast reinforced concrete wall.

Negative consequences with these products, cause these products are very large size of block, very heavy, difficult to cast from complicated of mold and methods of wall installation, and method of embedded horizontal rebars in both sides of the wall panels are not flexible and not suitable.

A precast reinforced concrete heavy duty retaining wall has improved from a half block of precast reinforced concrete walls H-shape by using a square wall panel, single panel of a pair square wall panels of a half block. Becomes a precast reinforced concrete heavy duty retaining wall.

BRIEF DESCRIPTION OF DRAWINGS

The foregoing and other aspects of the present invention will be best appreciated with reference to the detailed description of the invention, which follows, when read in conjunction with the accompany drawings wherein.

DETAILED DESCRIPTION OF THE INVENTION

Figure 1:
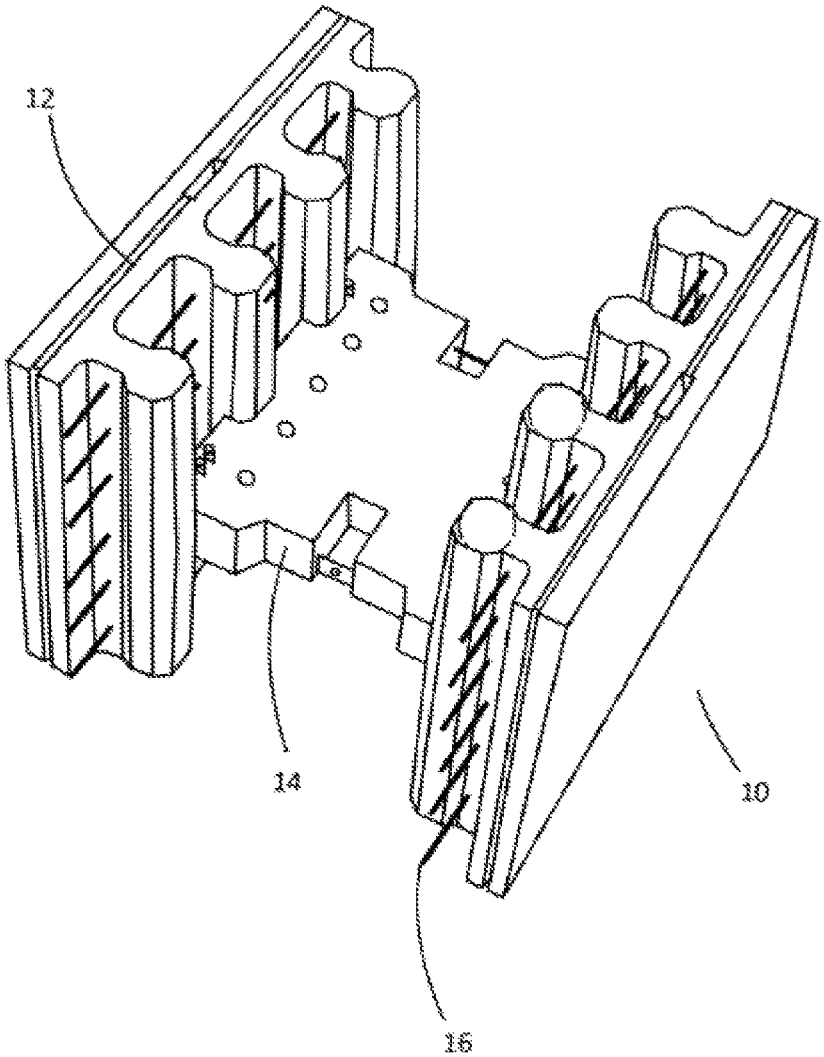
FIG.1 (PRIOR ART)
FIG. 1 represent a perspective view of a prior art a half block of a precast reinforced concrete walls H-shape.

As shown in FIG. 1 is a half block of Precast Reinforced Concrete Walls H-shape (10) comprise a pair of square concrete wall panel (12) front and rear are identical in shape and sizes, stand vertically on opposite direction, parallel to each other. And having a piece of flat panel (14) connected to a half of height, to cast in the configuration of H-shape. All ribs drilled thru in horizontal level, the diameter of holes equal to the diameter of horizontal rebars, embedded horizontal rebars (16) into all ribs during casting process.

Figure 2:
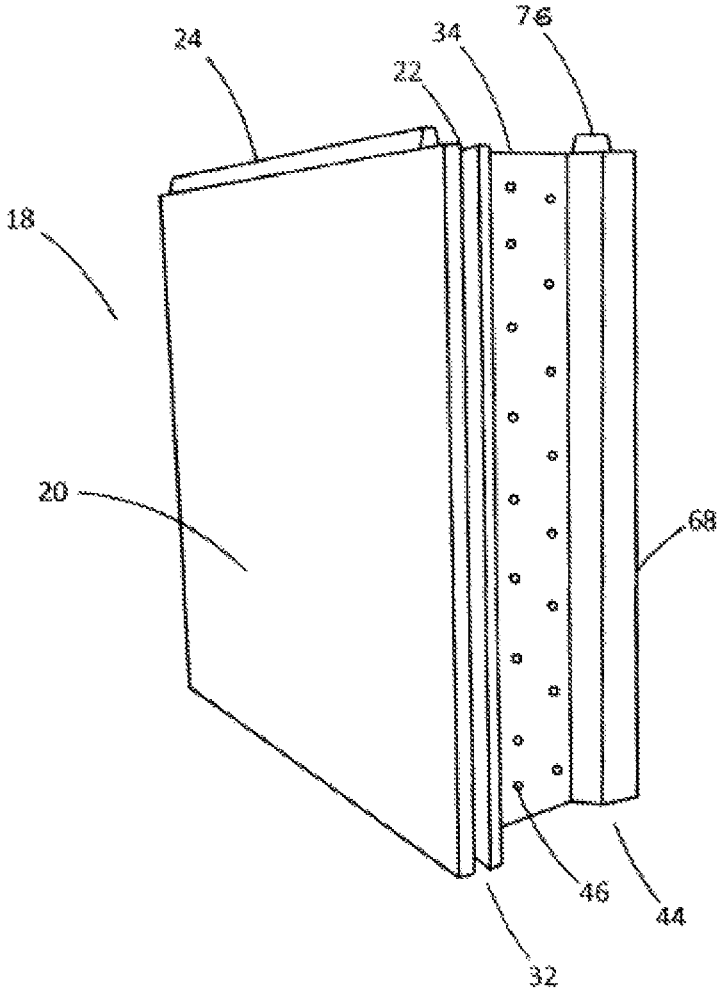
FIG. 2 represent a perspective view of face panel of a precast reinforced concrete heavy duty retaining wall.

As shown in FIG. 2 the Precast reinforced concrete heavy duty retaining wall (18) a face panel (20) comprising a substantially square wall panel, in which having wall thickness (22)

Figure 3:
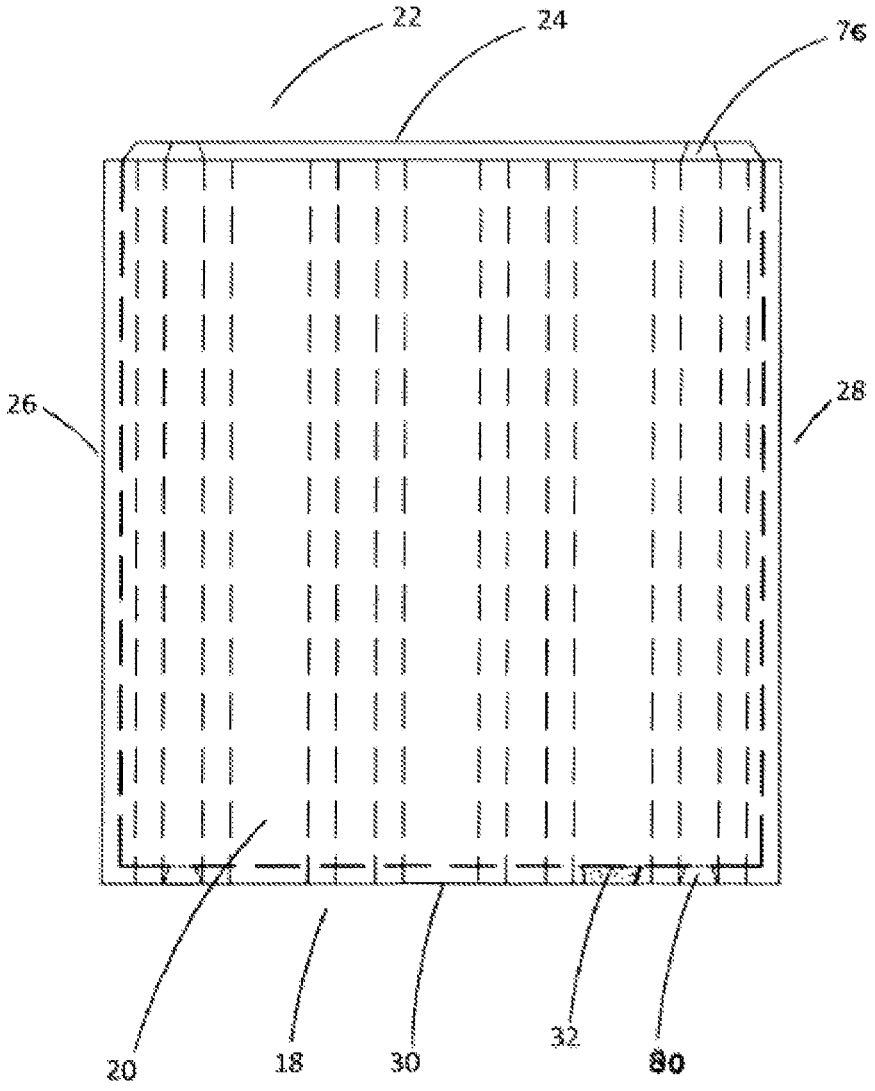
FIG. 3 represent a front view of face panel of a precast reinforced concrete heavy duty retaining wall.

As shown in FIG. 3 the precast reinforced concrete heavy duty retaining wall (18), the wall thickness (22) of upper surface having notch (24) for male interlocking, the left side surface (26), the right side surface (28), and the lower surface (30) having grooves (32) at three places. All sections, sizes, and configuration of notch (24) and grooves (32) are substantially equally, the positioning of notch (24) and the groove (32) of lower surface (30) are substantially opposite direction, and the lower groove could be seated on the notch (24) male interlocking firmly.

Figure 4:
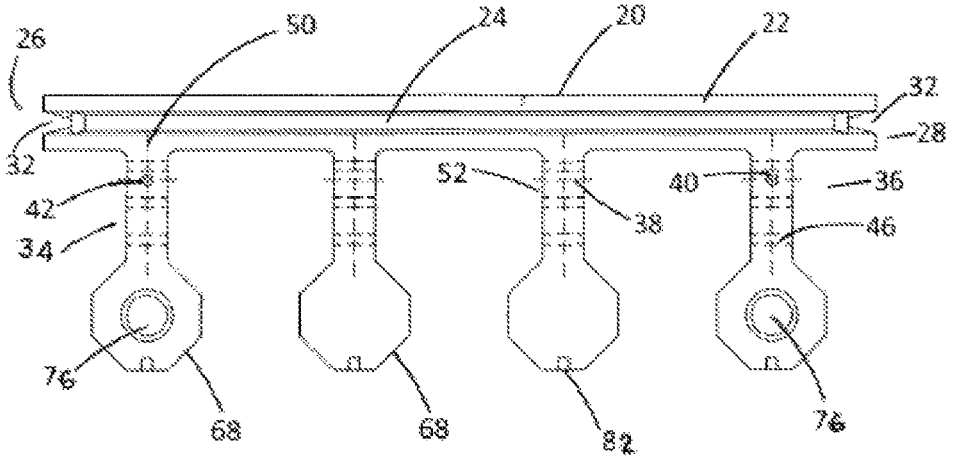
FIG. 4 represent a plan view of a precast reinforced concrete heavy duty retaining wall.

As shown in FIG. 4 the outer left (34) and outer right (36) of upper surface of fin panels, and at the position of center of gravity (38) passed thru these fin panels, having lifting points (40) at two places, by using internal thread rod (42). Embedded in the fin panels for connected with male tread of hoist assy to lifted precast reinforced concrete heavy duty retaining wall.

Figure 5:
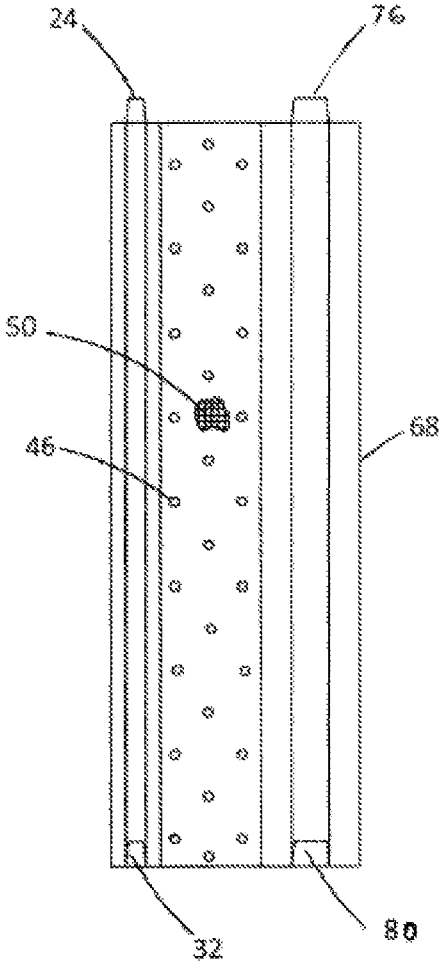
FIG. 5 represent a side view of a precast reinforced concrete heavy duty retaining wall.

As shown in FIG. 5 the side view (44) of precast reinforced concrete heavy duty retaining wall, drilled plurality of loose holes (46) in horizontally from the left fin panels thru the right fin panels respectively. The position of all holes divided in to three ways of vertical center lines. Using for placing horizontal rebars (48) from left fin panels thru right fin panels Each fin panel embedded wiremesh (50) at the center of fin panel before cast.

Figure 6:
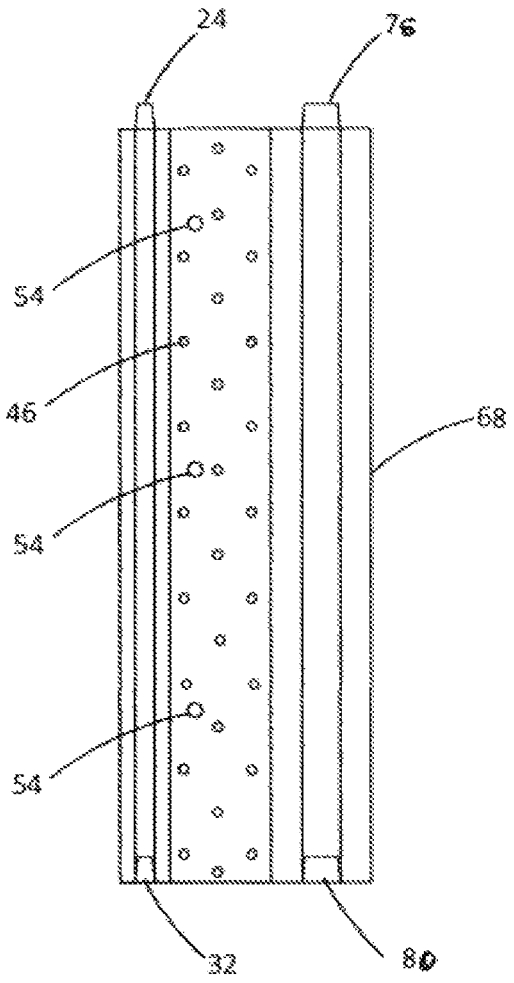
FIG. 6 represent the both outer left side view and outer right side view of fin panels of a precast reinforced concrete heavy duty retaining wall.
Figure 7:
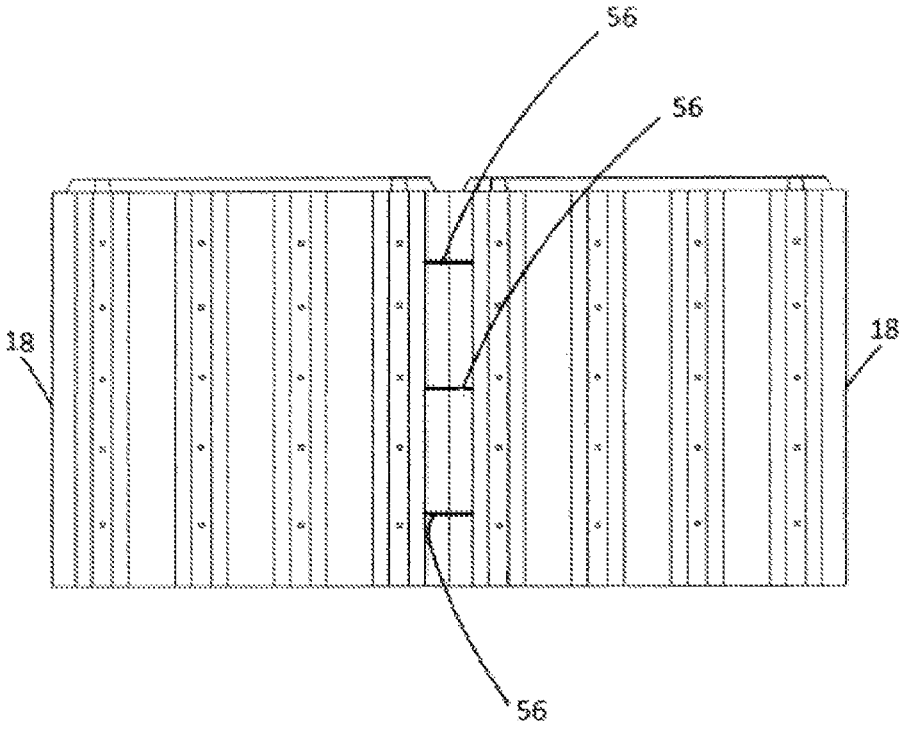
FIG. 7 represent the connection between the blocks of two precast reinforced concrete heavy duty retaining wall installation in row.

As shown in FIGS. 6 and 7 the outer left (34) and out right (36) of fin panels (52), of precast reinforced concrete heavy duty retaining wall (18), drilled three holes (54) the center line is in vertically, and the center of holes are at the center of gravity (38), the center of middle hole is a half of fin panel height, the center of upper hole and the center of lower hole to middle hole are not less than ¼ of fin panel height. Using for inserted turn buckles (56) to adjust between two precast reinforced concrete heavy duty retaining wall (18) close together.

Figure 8:
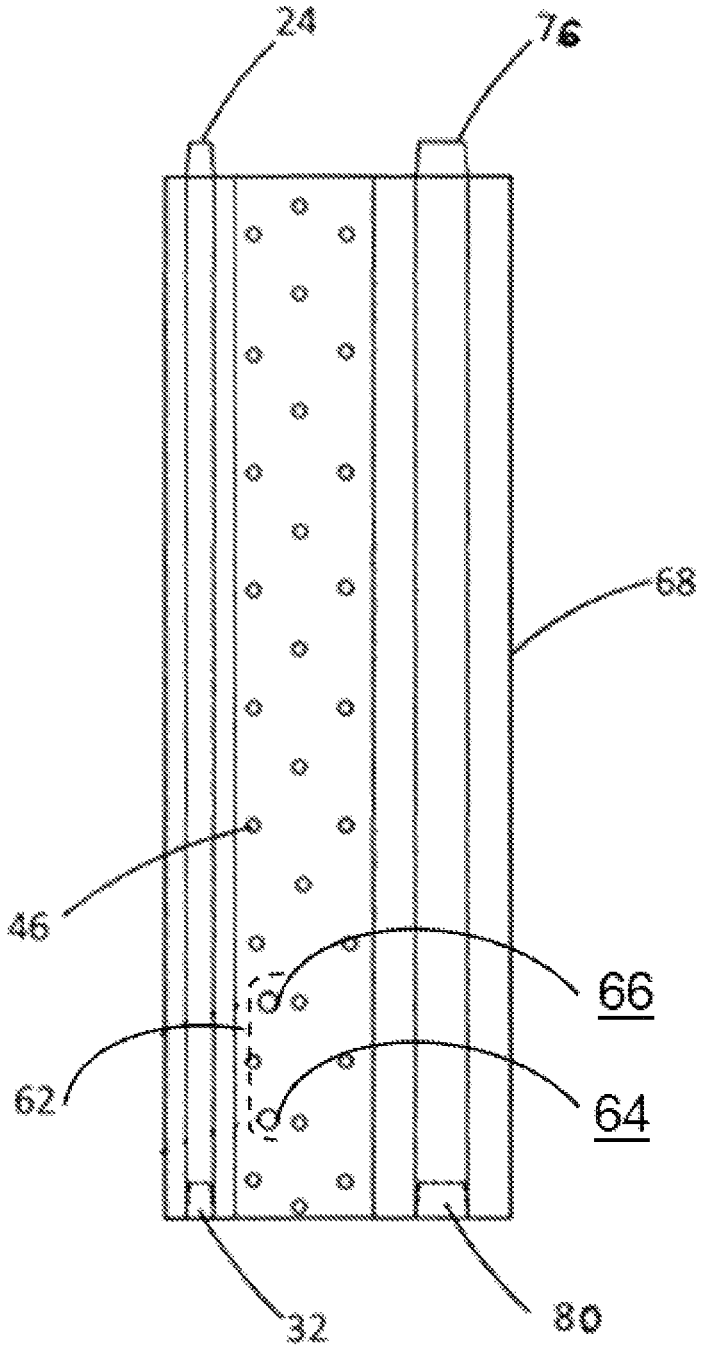
FIG. 8 represent the both inner left side view and inner right side view of fin panels of a precast reinforced concrete heavy duty retaining wall.
Figure 9:
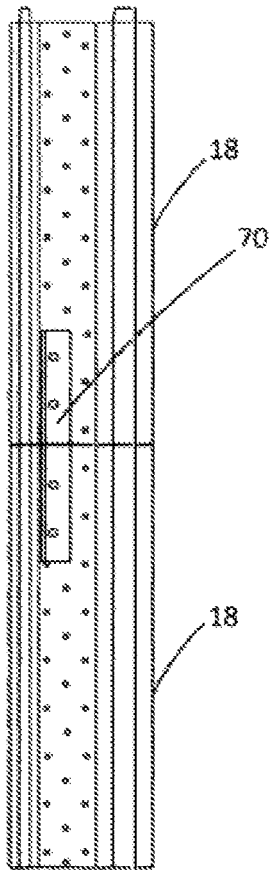
FIG. 9 represent the section view related the connection between the upper and lower of precast reinforced concrete heavy duty retaining walls installation in column.

As shown in FIGS. 8 and 9, the inner left of fin panels (52) of upper precast reinforced concrete heavy duty retaining wall (18), drill two holes (62), the center line is in vertically, the center line of holes are at the center of gravity (38), and the distance from the center of lower hole (64) to lower edge of fin panel (52) and the center of upper hole (66) to the center of lower hole (64) not less than 1/10 of fin panel height. On the contrary at the inner left of fin panel of lower precast reinforced concrete heavy duty retaining wall having two holes (62) at the upper of inner left (58) of fin panel, the center line of each hole is in vertically and the center of two holes are at the center of gravity (38). Both of precast reinforced concrete heavy duty retaining wall stand in vertically and adjacent together. The four holes of two precast reinforced concrete heavy duty retaining wall are in the same center line and equally spaced. Attached two pieces of equal legs angle (70) at the left surface and right surface of inner left (58) of fin panels, upper and lower of blocks, then bolted at four holes for stiffness between upper and lower of precast reinforced concrete heavy duty retaining walls during installation.

And likewise the inner right (60) of fin panel of upper and lower of precast reinforced concrete heavy duty retaining walls and inner left (58) of fin panel of upper and lower of precast reinforced concrete heavy duty retaining wall, the method to attached equal legs angle are all the same.

Figure 10:
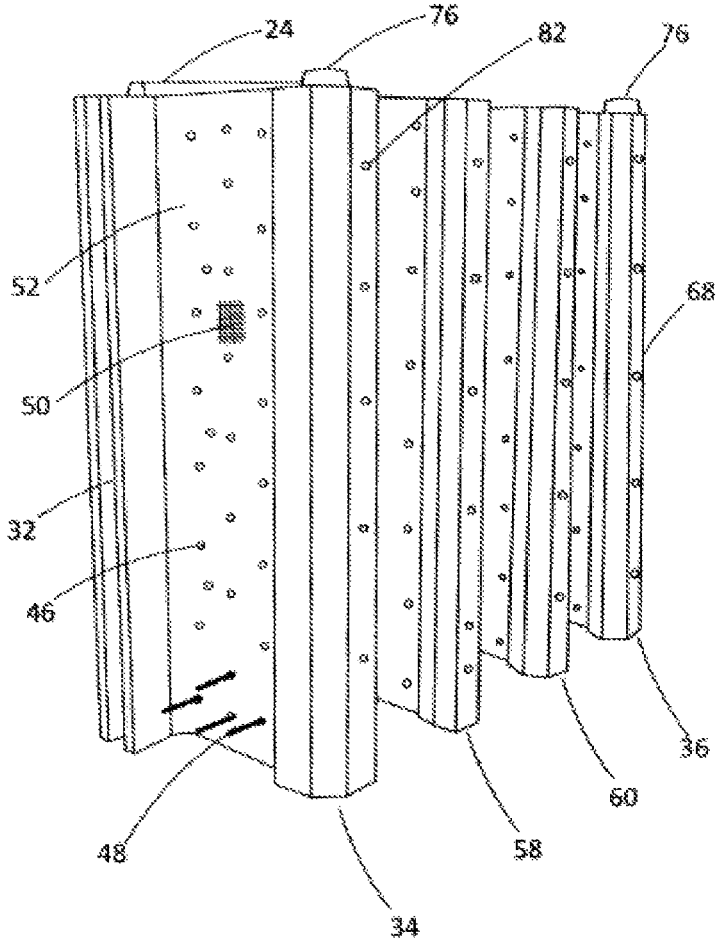
FIG. 10 represent a perspective view of rear view of a precast reinforced concrete heavy duty retaining wall.
Figure 11:
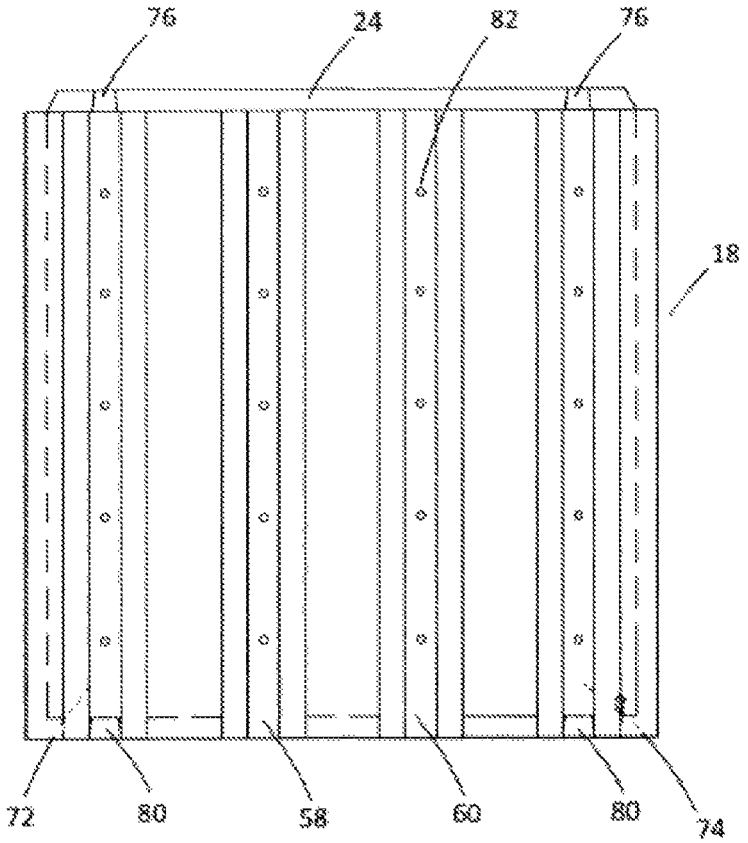
FIG. 11 represent a rear view of precast reinforced concrete heavy duty retaining wall, showing the front face of regular octagon columns.
Figure 12:
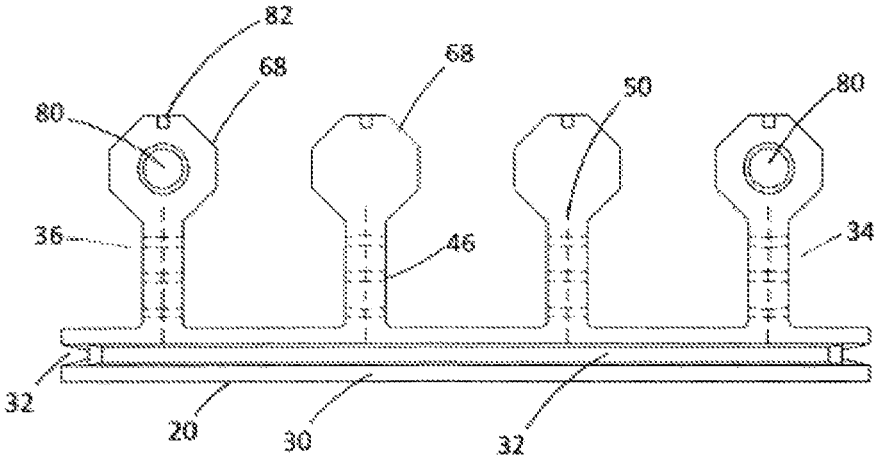
FIG. 12. Represent the bottom view of a precast reinforced concrete heavy duty retaining wall.

As shown in FIGS. 10, 11, and 12 the precast concrete heavy duty retaining wall, each fin panel (52) with integral regular octagon column (68), the height of them are equal to the height of face panel (20), the center of upper surface of outer left of regular octagon column (72) and outer right of regular octagon column (74) having protude male interlocking (76), the shape are round and taper and at the lower surface (78) of regular octagon column (68) having female interlocking (80) to worn with protude male interlocking (76) firmly.

At each front surface of regular octagon column as shown, drilled counter bore holes (82), in each column, the amount of counter bore holes not less than five holes. For inserted pro-anchor bolts. Using for fasten formwork and scaffolding attached to the regular octagon columns firmly.

BEST MODE FOR CARRYING OUT THE INVENTION

As mentioned on the topic of disclosure of the invention absolutely.

The invention claimed is:

1. A first and second precast reinforced concrete walls, wherein each of the first and second precast reinforced concrete wall comprising: a face panel comprising:

a substantially square wall panel having a wall-thickness;

four fin panels integrally formed at a rear side of the face panel, wherein an inner left fin panel amongst the four fin panels includes two vertically arranged holes provided at a lower end of the inner left fin panel, and a distance between the vertically arranged holes and a lower edge of the inner left fin panel is greater than 1/10 of a height of the respective fin panel, wherein the first and second precast reinforced concrete walls are vertically disposed and adjacent to each other, wherein the inner left fin panel of the second precast reinforced concrete wall is provided with a couple of vertically arranged holes provided at an upper end of the inner left fin panel of the second precast concrete wall, wherein the vertically arranged holes provided at a lower end of the inner left fin panel of the first precast reinforced concrete wall and the couple of vertically arranged holes provided at an upper end of the inner left fin panel of the second precast concrete wall are in-line when the second precast concrete wall is arranged on the first precast reinforced concrete wall; and an angle leg having four apertures complementary and bolted to the hole formed in the both precast reinforced concrete wall, when both the first and second precast reinforced concrete walls are arranged vertically.

2. The first and second precast reinforced concrete walls of claim 1, wherein an upper surface of the square wall panel, at the wall-thickness, is provided with a notch, wherein a left surface, a right surface, and a lower surface, of the square wall panel are provided with grooves, at the wall-thickness.

3. The first and second precast reinforced concrete walls of claim 2, wherein the notch, and the grooves provided on the square wall panel are complementary to each other, wherein the position of the notch and the groove provided at the lower surface of the square wall panel are in an opposite direction with each other, and the groove provided at the lower surface of the square wall panel is adapted to be seated on a notch of another face panel.

4. The first and second precast reinforced concrete walls of claim 1, wherein an upper surface of an outer left and an outer right fin panels amongst the four fin panels, includes lifting points, at which a center of gravity of the first and second precast reinforced concrete walls passes through the four fin panels, wherein each of the lifting points is provided with an internal female threaded rod embedded in the outer left and the outer right fin panels.

5. The first and second precast reinforced concrete walls of claim 4, wherein a plurality of loose holes is drilled on each of the fin panel in horizontally from the outer left fin panel thru the right fin panels respectively, wherein the plurality of loose holes is drilled in three vertical rows and rebars are positioned in the vertical rows of the plurality of loose holes.

6. The first and second precast reinforced concrete walls of claim 5, wherein three holes are drilled at the outer left and outer right of fin panels in between a row amongst the vertical rows of the plurality of loose holes, wherein a middle hole amongst the three holes is at a half distance of the height of the fin panel, and the other two holes amongst the three holes at a distance greater than ¼ of the height of the fin panel, wherein the three holes are adapted to receive one end of a turnbuckle and other end of the turnbuckle connected to another precast reinforced concrete wall.

7. The first and second precast reinforced concrete walls of claim 5, wherein at a center of each fin panel includes embedded wire mesh for reinforcement.

8. The first and second precast reinforced concrete walls of claim 5, wherein at the end of each fin panel is provided with a octagon shaped column integrally formed with the fin panel.

9. The first and second precast reinforced concrete walls of claim 8, wherein an upper surface of an outer left and an outer right octagon columns of respective fin panels includes a male interlocking, and an lower surface of the outer left and the outer right octagon columns of respective fin panels includes a female interlocking.

10. The first and second precast reinforced concrete walls of claim 8, wherein each octagon column of the fin panels comprises counter bore holes drilled at a half of a front surface width of the octagon column to enable coupling of a scaffolding.

* * * * *